United States Patent [19]

Trisl

[11] Patent Number: 4,799,588

[45] Date of Patent: Jan. 24, 1989

[54] PRESENTATION OR DISPLAY BASE

[75] Inventor: Klaus Trisl, Wiesbaden, Fed. Rep. of Germany

[73] Assignee: Uhrenhandelsgesellschaft mbH, Hamburg, Fed. Rep. of Germany

[21] Appl. No.: 942,417

[22] PCT Filed: Jan. 23, 1986

[86] PCT No.: PCT/EP86/00025

§ 371 Date: Oct. 1, 1986

§ 102(e) Date: Oct. 1, 1986

[87] PCT Pub. No.: WO86/04796

PCT Pub. Date: Aug. 28, 1986

[30] Foreign Application Priority Data

Feb. 21, 1985 [EP] European Pat. Off. ..... 85101879.6

[51] Int. Cl.[4] ..... B65D 1/34; A47F 7/024

[52] U.S. Cl. ..... 206/301; 206/558; 206/560; 206/564; 206/566; 211/4

[58] Field of Search ..... 312/126; 211/13, 4, 211/7; 206/301, 18, 566, 560, 561, 565, 45.13, 564

[56] References Cited

U.S. PATENT DOCUMENTS

| | | | |
|---|---|---|---|
| 267,090 | 11/1882 | Lewkowitz | 206/560 |
| 672,561 | 4/1901 | Loeb | 206/566 X |
| 732,089 | 6/1903 | Lenzen | 206/560 |
| 755,021 | 3/1904 | Lenzen | 206/566 X |
| 989,571 | 4/1911 | Dahl | 206/560 |
| 1,436,233 | 11/1922 | Brown | 206/560 |
| 1,994,363 | 3/1935 | Kettendorf | 206/560 |
| 2,405,369 | 8/1946 | Poulsen et al. | 211/4 |
| 2,925,907 | 2/1960 | Griene et al. | 206/565 X |
| 3,204,774 | 9/1965 | Barbieri | 211/4 |
| 3,964,603 | 6/1976 | Sandler | 206/560 |
| 4,011,942 | 3/1977 | Crosslen | 206/45.14 |
| 4,511,041 | 4/1985 | Waitzman | 206/566 |
| 4,650,077 | 3/1987 | Droz | 206/480 X |

FOREIGN PATENT DOCUMENTS

| | | | |
|---|---|---|---|
| 2114419 | 3/1971 | Fed. Rep. of Germany | 206/301 |
| 2176245 | 10/1973 | France | 206/564 |
| 2166347 | 5/1986 | United Kingdom | 211/4 |

*Primary Examiner*—Stephen Marcus

*Attorney, Agent, or Firm*—Jordan B. Bierman

[57] ABSTRACT

Proposed is a presentation tableau (100) to take in particular wrist watches each encompassing on a display holder (102) which in turn, to a desired extent, can be locked by means of sliding element (126) in a recess (14) in the presentation tableau (100). The display holder (12) itself is additionally protected against displacement by a projection (150) extending therefrom, and which interacts with an opening (152) provided in a surface (20, 22) forming the side wall of the said recess (14).

21 Claims, 8 Drawing Sheets

Figure 1:
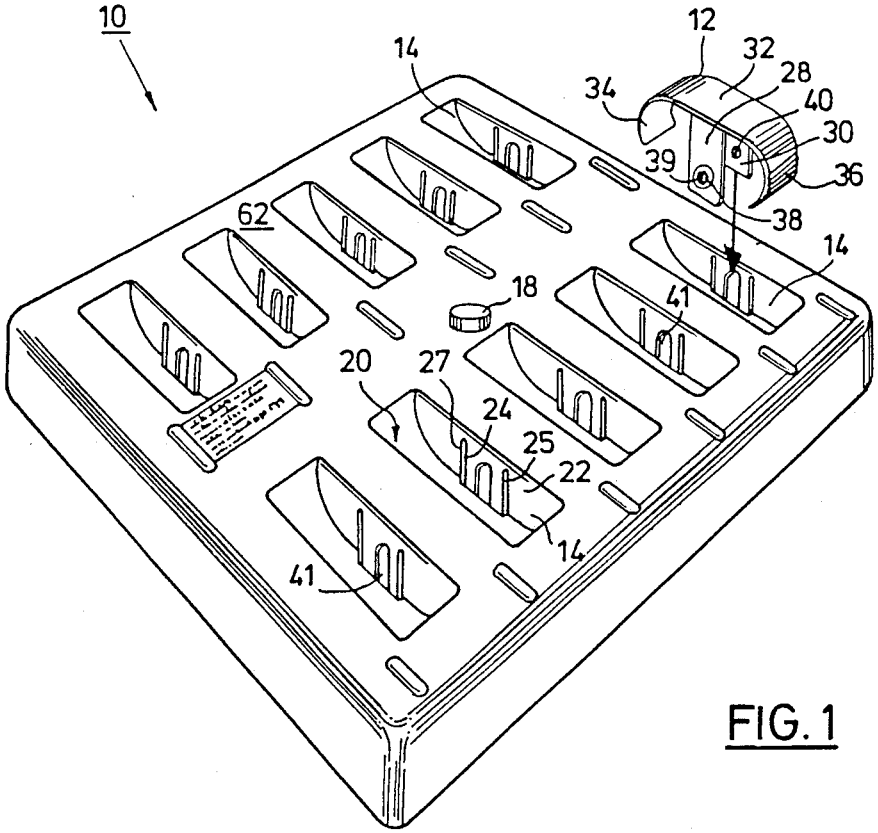

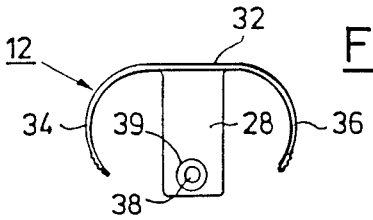
FIG. 5
FIG. 4
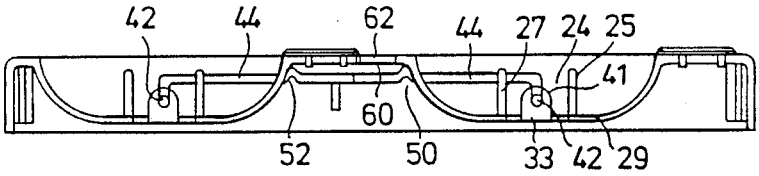
FIG. 3
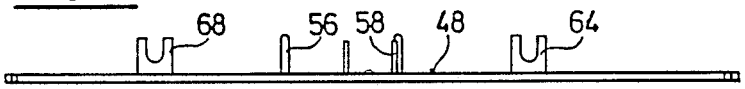
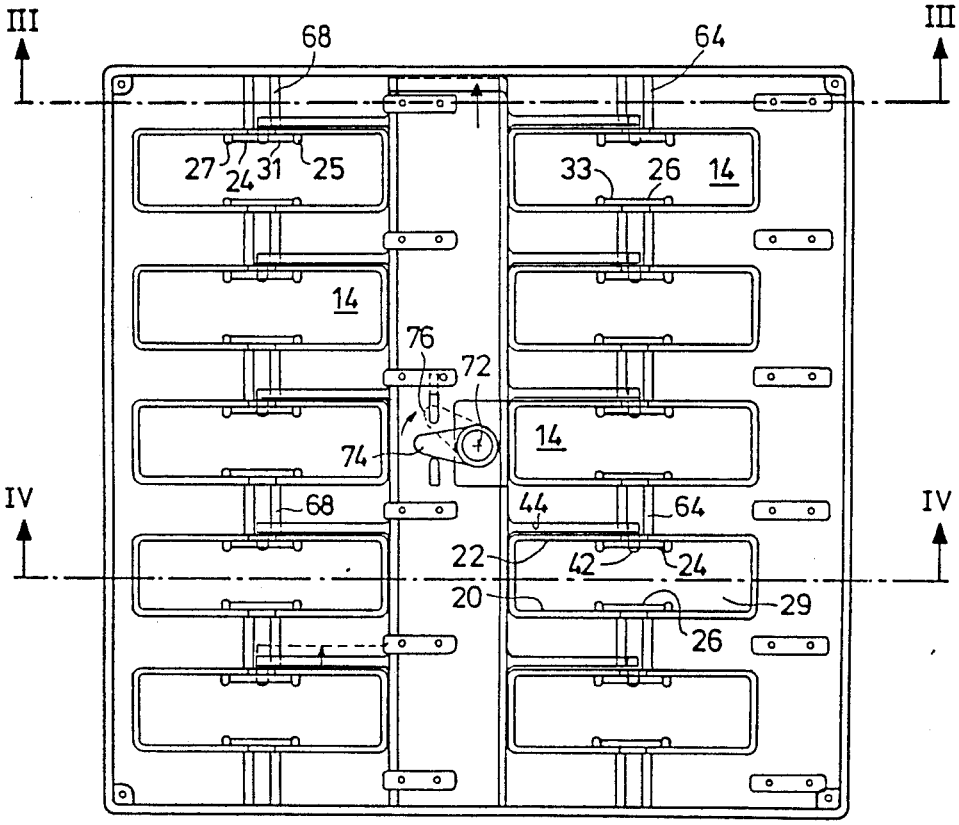
FIG. 2

FIG. 10
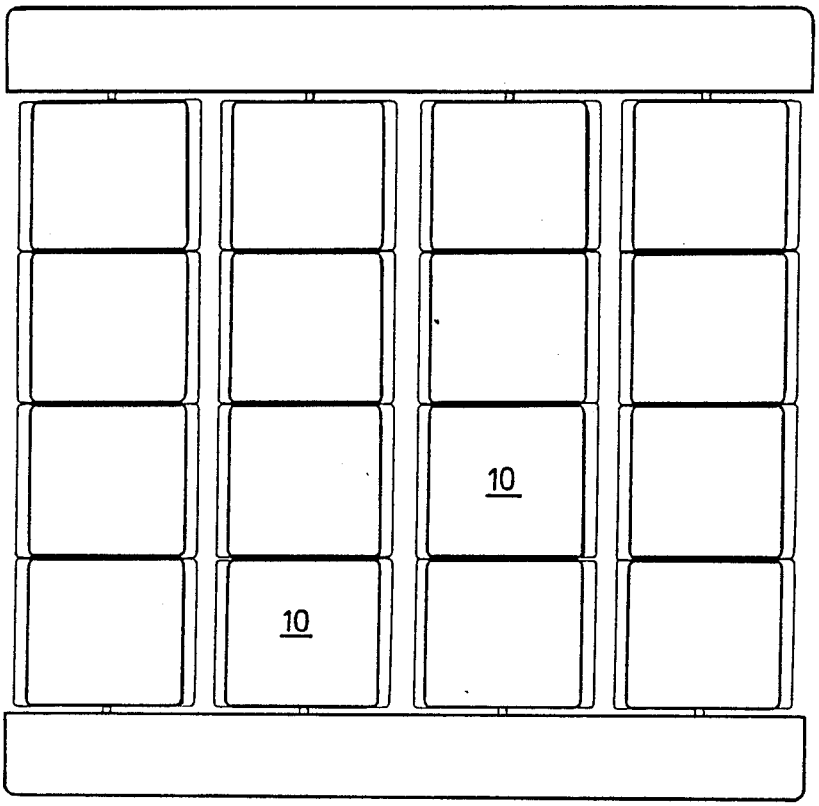
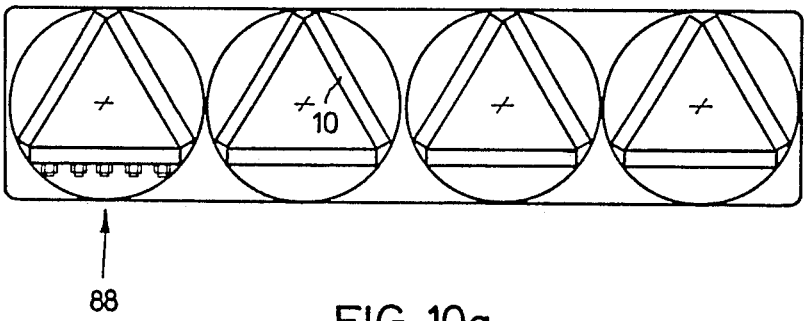
FIG. 10a

PRESENTATION OR DISPLAY BASE

STATE OF THE PRIOR ART

The invention relates to a presentation tableau on which to mount objects such as wrist watches, whereby each of these objects at least partially encompasses a removable mounting which can be fitted into a recess on the presentation tableau.

Today it is necessary to offer potential customers goods as comprehensively as possible, without thereby being obliged to increase the number of sales personnel. If is thus necessary, especially in the case of small but high-value objects to protect then from theft. There are therefore already in existance glass showcase fronts behind which wrist watches or similar objects are displayed. However, glass showcases have the disadvantage of being relatively expensive. Moreover, the glass surfaces must be very frequently cleaned, since otherwise the showcases become unattractive. Another disadvantage is that the customer cannot directly touch goods displayed in this manner, a necessity which has a positive effect on any decision to buy. Of course, it is possible to use chains to protect wrist watches in particular from uncontrolled removal from presentation cases or similar.

However, treatment in this way is not only inconvenient but also engenders an atmosphere or mistrust toward the potential customer, which is something that must be avoided.

Aim of the Invention

The aim of this invention is to design a presentation tableau (presentation case) of the type described above, in which objects especially such as wrist watches can be openly offered for sale and, at the same time, protected from uncontrolled removal without this precaution being obvious to the potential customer.

The aim is achieved in that arranged inside the presentation tableau and in its bottom region is at least one sliding element, which interacts with at least one segment projecting from a display holder fitted into the presentation tableau. A suitable projection preferably takes the form of flat, rectangular-section leg, which extends towards the bottom of the presentation tableau preferably in a guide. The lateral edges of this leg are now provided with notches, which interact with the sliding element such that the display holder can either be removed or is secured against theft, as desired at the time. Each display holder preferably has two mutually parallel legs extending from the central section of said display holder. A section of the object mounted on the display holder, e.g, the strap of a wrist watch, then runs between the legs. The sliding element, which can also be referred to as the locking element, is let into a plate-shaped element which can be shifted along the bottom of the presentation tableau, and which represents a specially emphasized design feature of the invention. Thus two mutually interlinked cutouts per sliding element or locking element are provided in the plate-shaped element; hereby on the one hand, the transition region between these cutouts and, on the other hand, one end section thereof form projections which interact with the notches in the legs. Consequently, the widths of the individual cutouts outside the projections are selected larger than those of the legs. In the unlocked position, the free ends of the legs lie within the cutouts without being restricted by them. Conversely, in the secured position, the projections of the sliding or locking element engage in the notches such that the display holder cannot be taken out of the presentation tableau.

The aim is further solved in that inside the presentation tableau and extending along its bottom surface is a sliding element with rod-shaped projections extending from its sides, each of these rod-shaped elements being allocated to one of the display holders fitted into the presentation case. By means of the sliding element and the devices projecting from it (which can be referred to as 'fingers') the display holder, enclosed by an object such as wrist watch, can be secured in such a way that it cannot be covertly removed from the presentation tableau. The display holder cannot be removed until the sliding element, and thus the fingers, are slid into a position in which the rod-shaped elements are no longer engaged in the display holders.

With both of these proposed solutions the anti-theft security device cannot be easily detected, so that no mistrust is overtly shown towards the customer. Suitably designed presentation tableaux can also be arranged to form columns or walls, thereby providing a large sales area without needing a large number of sales personnel to monitor them. In consequence, according to the invention and in comparison with conventional forms of presentation, an additional advantage is achieved in that, without increasing the number of sales personnel, more items such as wrist watches can be exhibited and therefore offered for sale.

It is also possible to arrange the subject presentation tableaux in prism-sectioned columns, which can be rotated about their longitudinal axes. Thus, for example, a visible surface area of one square meter can be increased to an effective presentation area of three square meters, whereby in turn the number of objects offered is increased in comparison with conventional arrangements.

The design of this invention forsees in each recess at least one guidance feature on one inside wall to take one display holder, into which a segment of said display holder is removably inserted. When a display holder is mounted in the presentation case, that segment of it which runs in the guide thereby acts together with the sliding element. In this way, either the free end of the rod-shaped element can project through an opening such as a drilled hole in the leg segment of the display holder, or else the projections on the sliding element can be pushed into notches in the side of said segment. This provides protection against unauthorized removal. For preference, one guideway should be provided per recess on adjacently opposite side walls thereof, each being allocated to one segment of a display holder. Said segments hereby project parallel to one another from a section of the display holder designed to serve as a supporting surface, e.g., on which to mount the wrist watch. The display holder, e.g., for one wrist watch, can take the usual shape; that is, a bracelet-like structure with the already-mentioned parallel segments projecting down from the edges of its middle section. Consequently, the side elevation of the display holder as fitted into the invented presentation case has an approximate T-shape, whereby the ends of its transverse section are each curved towards the centre legs, which are in fact the leg-shaped segments which can be locates in the guideways.

Emphasis is placed upon an independent design feature of the invention in respect of the guideways and the legs which can be inserted into them; this feature ensures that display holders which have been fitted into the tableau but not yet locked cannot unintentionally drop out. Thus the bottom surfaces of the recesses for the display holders have slot-shaped openings into which project the free ends of the mutually parallel legs of the inserted display holder; this arrangement prevents the legs from being moved towards each other. Moreover, each of these legs has a reinforcement feature, e.g., such as bead, extending towards one of the openings in one of the adjacent sidewalls. This provides additional security and thus located the display holder so that it cannot unintentionally slip or even fall out of the tableau. In so far as the sliding element takes the form of the rod-shaped element, its free end pentrates the leg within the reinforcing feature.

Refinements of the invention are evident from the claims.

DESCRIPTION OF A PREFERRED DESIGN EXAMPLES

Further details, advantages and features of the design are additionally evident from the following description of the preferred design examples illustrated in the drawings.

Shown are:

FIG. 1 A perspective drawing of the invented presentation tableau

FIG. 2 A plan elevation of the presentation tableau as in FIG. 1, sectionalized

FIG. 3 A sectional view along the line III/III in FIG. 2

FIG. 4 A sectional view along the line IV/IV in FIG. 2

Figure 6:
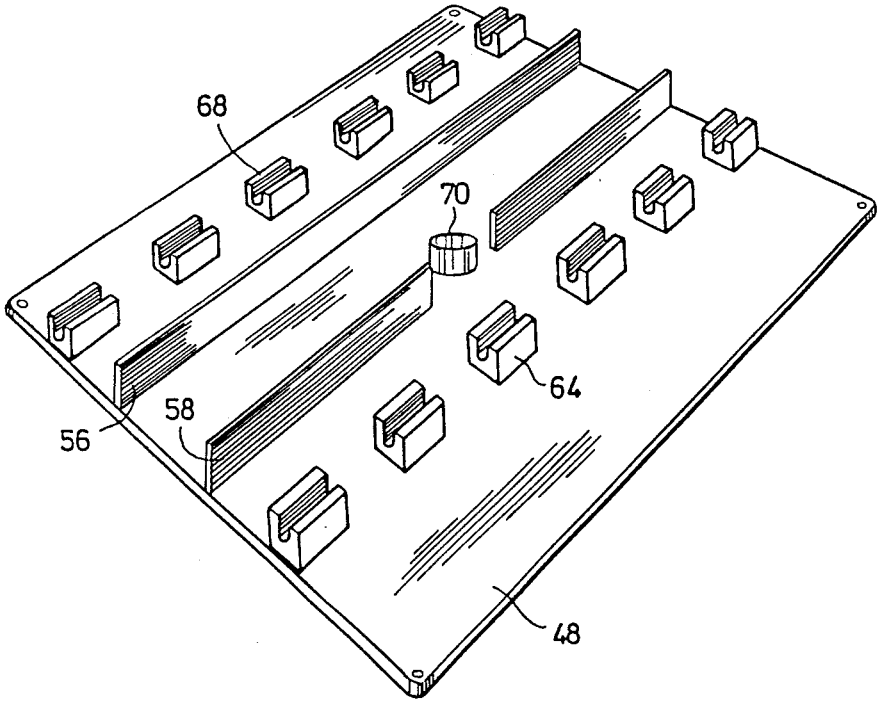

FIG. 5 A side elevation of a display holder for mounting in the presentation tableau FIG. 6 A perspective drawing of the bottom plate of the presentation tableau as in FIG. 1

Figure 7:
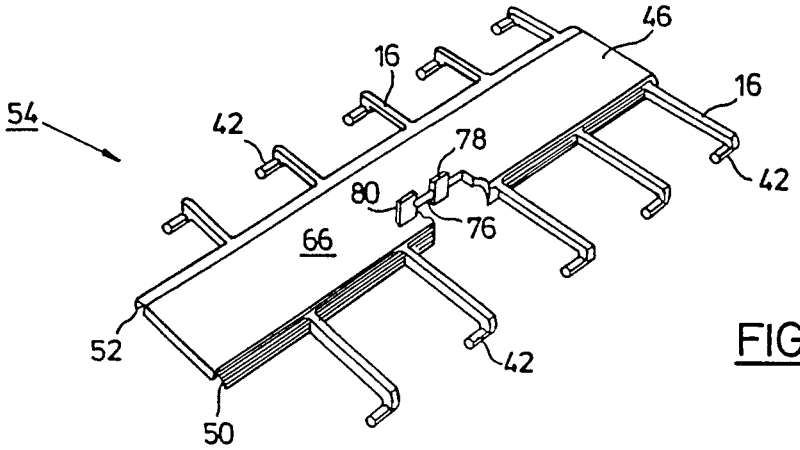

FIG. 7 A detailled drawing of a sliding element

Figure 8:
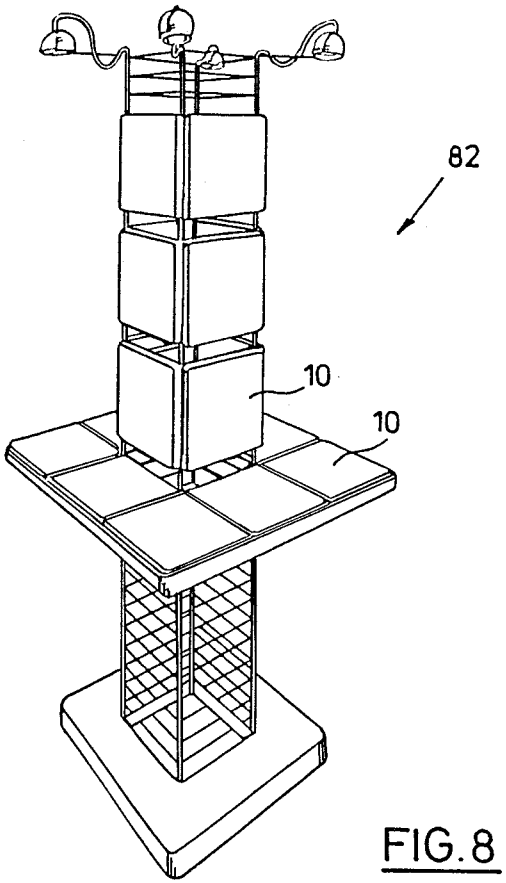

FIG. 8 Several presentation cases as in FIG. 1 arranged in a column

Figure 9:
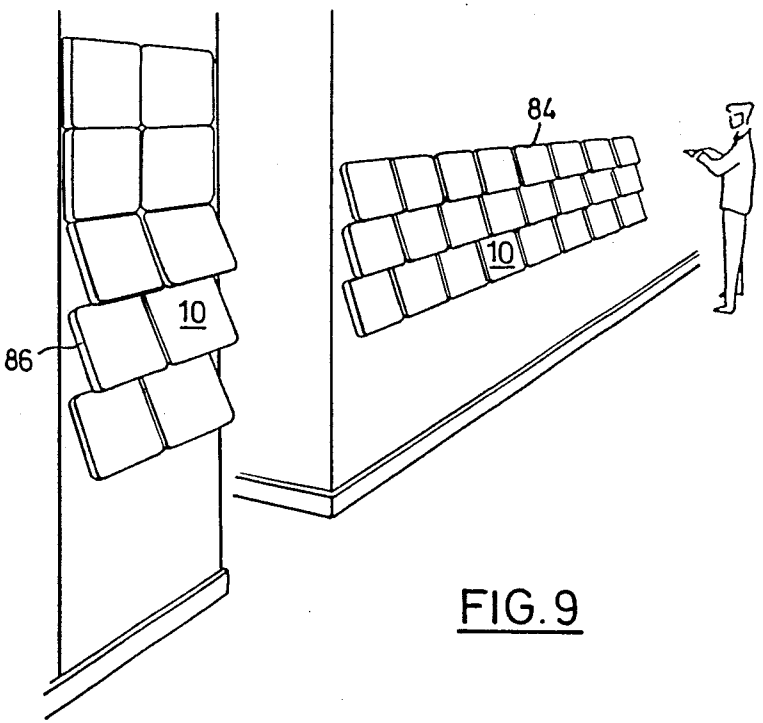

FIG. 9 Several presentation cases as in FIG. 1 arranged as a wall unit

Figure 11:
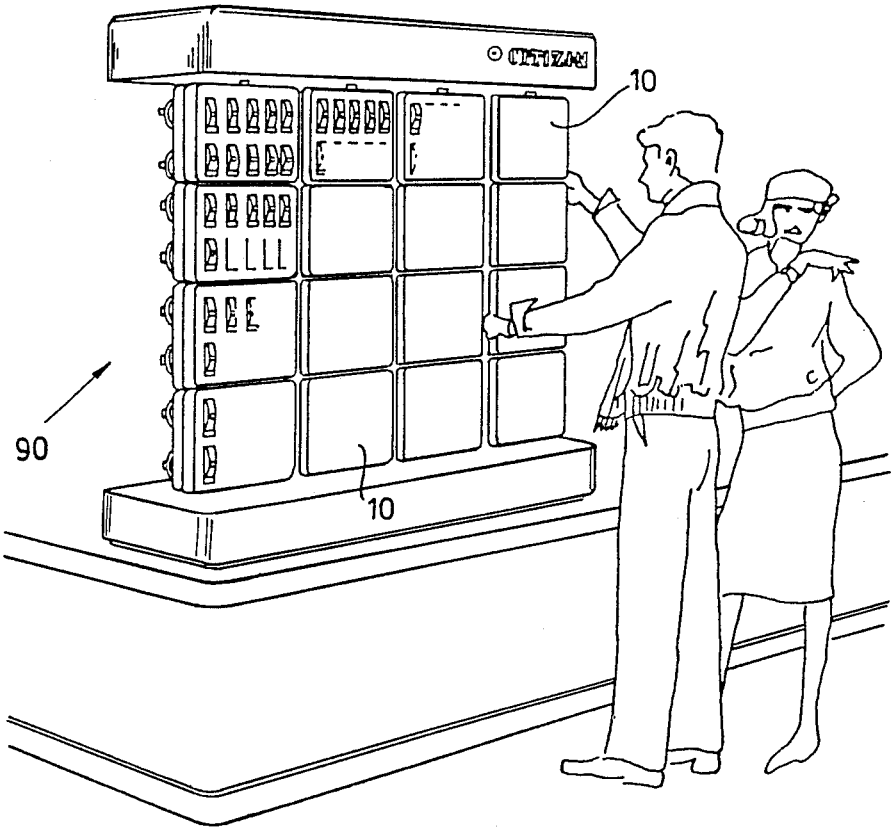
Figure 12:
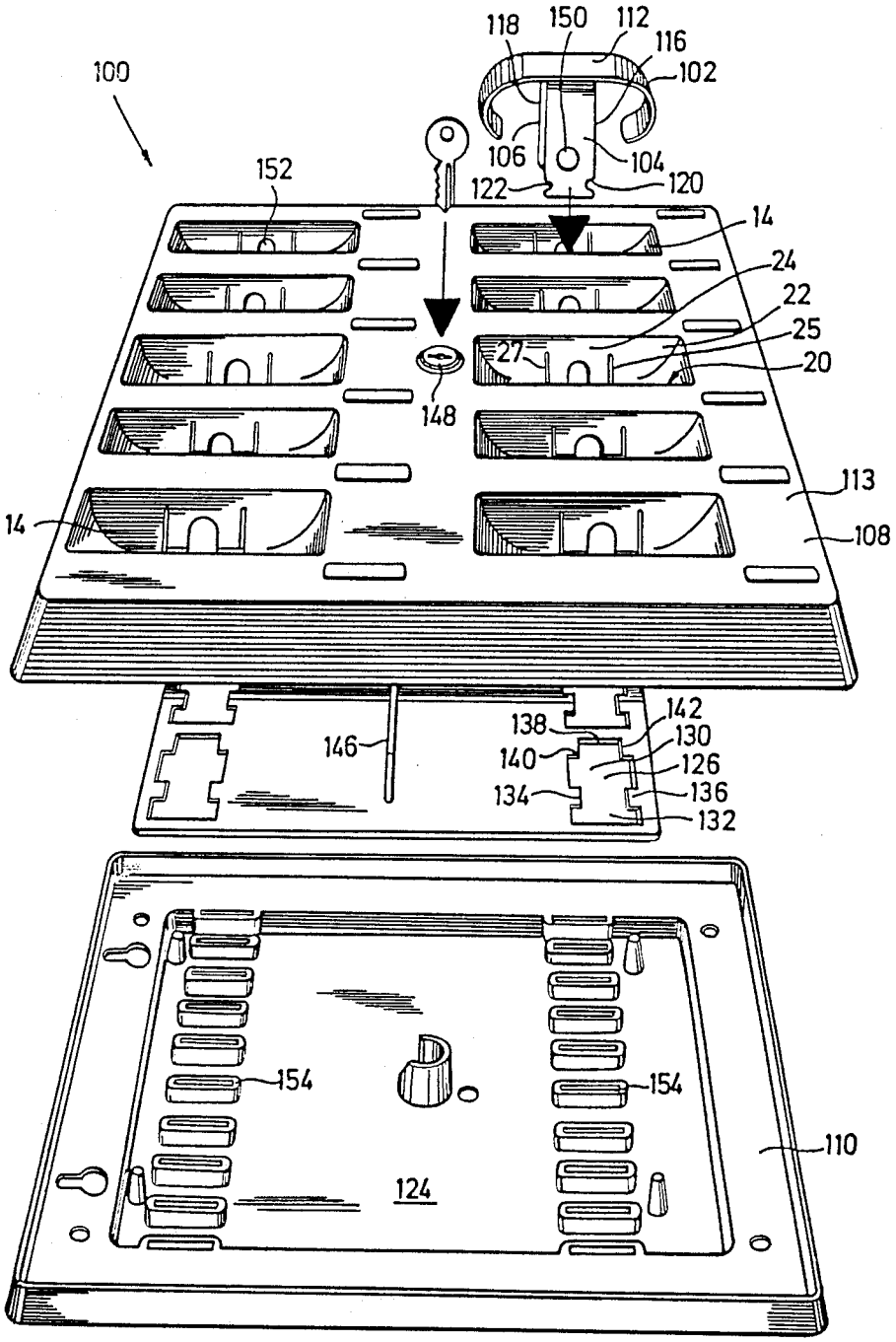
Figure 13:
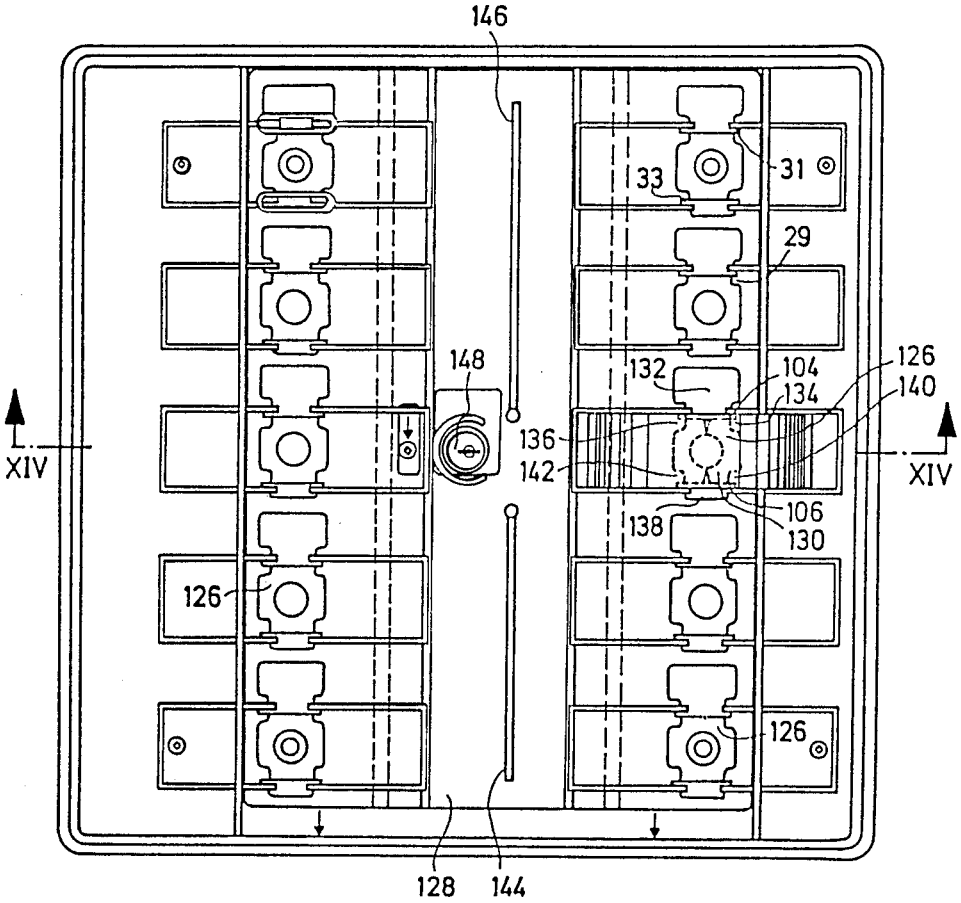

FIGS. 10 and 10A Presentation cases as in FIG. 1 arranged in rotatable prismatic-section columns FIG. 11 A further arrangement in which presentation tableaux are arranged to form display walls FIG. 12 An exploded view of design feature of the presentation tableau to be specially emphasized FIG. 13 A plan elevation of the presentation tableau as in FIG. 12

Figure 14:
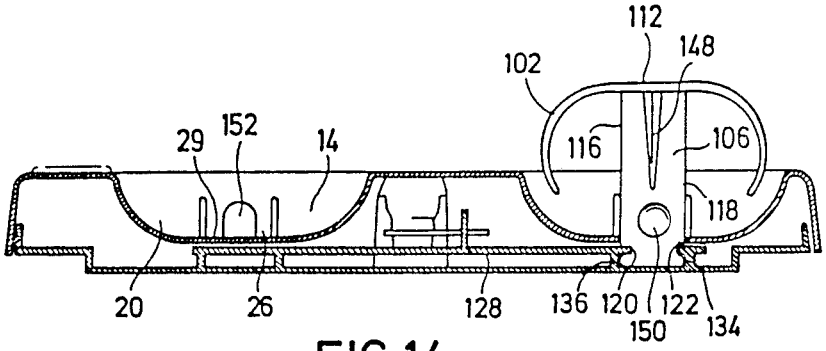

FIG. 14 A sectional drawing along line XIV/XIV in FIG. 13.

FIG. 1 shows a perspective drawing of a presentation tableau (case) 10 according to the invention, which is intended to take wrist watches in a thief-proof form, and each of which in turn is fitted around a display holder (12). The display holders (12) are secured in the recesses (14) provided in the presentation tableau (10) and which will be described in more detail on the basis of FIGS. 2 to 6.

The preferred shape of the presentation tableau (10) is a rectangular block, and in the design example has a total of 10 recesses (14) for wrist watches and associated display holders (12). An exchangeable information card can be allocated to each recess (14). This can be a pricing label or else a technical description. As can be seen, also provided in the central area of the presentation tableau is a key opening (18) to allow a locking device to be operated so as to secure the display holders (12) fitted into the recesses (14).

Moreover, the recesses (14) are provided on their long sides 20 and 22 with guides 24 and 26 respectively, these being spatially delineated by mutually parallel webs 25, 27 into which can be fitted the parallel legs 28 and 30 respectively of the display holder 12. In the bottom surface 29 of the recesses 14 are slot-shaped openings 31 and 33 below the guides 24 and 26 respectively, and into which the free ends of the legs 28 and 30 of the display holder 12 engage when fitted into the tableau 10. This arrangement ensures that the legs 28 and 30 cannot be moved towards each other. In addition, each hole 38, 40 in the leg 28, 30 is surrounded by a bead 39; when a display holder 12 is fitted into the recess 14, said bead 39 interacts with the opening 41 in the inside wall 20, 22 between the guide 24, 26, i.e., it engages therein thereby making it impossible for the display holder 12 to slide out unintentionally. The additional safety measures previously described for the display holder 12 are to be seen as representing an independent, patentable design feature of the invention.

The legs 28 and 30 project preferably from the central region of a supporting surface of the display holder 12, the side elevation of which (FIG. 5) consequently exhibits a T-shape with its projecting ends 34 and 36 respectively being bent inwards towards the legs 28, 30. In other words, the display holder 12 comprises a bracelet-shaped basic body of familiar form and enclosed by the armband of a wrist watch. Additionally, however, the legs 28 and 30 project from the bracelet-shaped basic element which, corresponding to the associated recess 14, are so shaped they can be inserted into the guides 24 and 26 (see arrow in FIG. 1). In the end region of the legs 28 and 30 are openings corresponding to holes 38 and 40, and through which passes one free end 42 of a rod-shaped element 16. This rod-shaped element 16 projects from a base plate 46, which can be slid within the presentation tableau 10 parallel to its bottom plate 48 in such a way that the free ends 42 of the rod-shaped elements 16 can be made to engage in the openings 38, 40 of the legs 28, 30 of the display holder 12 as required. In other words, by positioning the base plate 46 and consequently the free ends 42, one can determine whether the display holders 12 with the wrist watches mounted on them can, or cannot be removed from the presentation tableau 10. The rod-shaped element 16 offering security to the display holder 12 together with the base plate 46 form the sliding element 54, featuring slot-shaped recesses 50, 52 running longitudinally in it and into which longitudinal webs 56 and 58 on the bottom plate 48 can engage. This provides guidance for the sliding element 54 in its longitudinal direction. In order to prevent any movement perpendicular thereto, the base plate 46 comes at least partially into contact with the inside surface 60 of the top section 62 of the presentation housing. For preference this should occur in the region of the slot-shaped recesses 50 and 52, the free top sides of which project above those of the top surface 66 of the base plate 46.

The free ends 42 of the rod-shaped elements 16 (which can also be called 'fingers') run parallel to the direction of motion of the sliding element 54, so that, in a controlled manner, they can penetrate into or be withdrawn from the corresponding openings 38 and 40 in the legs 28 and 30 of the display holder 12. In so far as to provide the sliding element 54 and its motion with additional stability, the free ends 42 of the fingers 16 are guided in bearing devices 64 and 68 respectively, which project from the bottom plate 48. So that this motion is not hindered by the sections 44 of fingers 16 projecting from base plate 46 at right angles to its direction of motion, the end sections 42 of said perpendicularly projecting sections 44 are offset towards the bottom plate 48. In other words, each finger 16 serving to lock the display holders 12 takes the form of two previously-described sections 42 and 44 mutually at right-angles and interspaced by a step-down section.

In the region of web 58 is an opening in which is arranged a matching abutment 70 to receive the locking device 72. In its turn, the locking device 72 is provided with a projecting tongue 74, which engages in an opening 76 formed by two mutually separated projections 78 and 80 extending from the top surface 66 of the base plate 46. By turning the tongue 74 (continuous- and broken-line drawing in FIG. 2) the sliding element 54 can be shifted along webs 56 and 58. This results in interaction or engagement of the free ends 42 of fingers 16 in the display holders 12 or the legs 28, 30 projecting therefrom.

From FIGS. 12 to 14 one can see especially notable design features for a presentation tableau 100 that basically corresponds to the form of construction described in FIGS. 1 to 7. For this reason, the same reference figures are allocated to the corresponding elements.

Tableau 100 consists of an upper section 108 which be joined to the lower section 110, e.g., by screws. Let into the top surface 112 of the upper section 108 are recesses 14 in which the display holders 102 can be fitted, these latter each comprising a bracelet-shaped main body 114 with a mounting surface 112 from which project legs 104 and 106. The display holder 102 is consequently C-shaped similar to display holder 12, as shown in FIG. 5. The legs 104 and 106 engage in the guideways 24 and 26 on the long sides 20 and 22 respectively of the recesses 14, said guideways being delineated by mutually parallel webs 25 and 27. In the bottom surface 29 of the recess 14 below the guides 24 and 26 are slot-shaped openings 31 and 33 respectively, into which the free ends of legs 106 and 104 engage when the display holder 102 is inserted into the tableau 100. Hereby the free ends of the legs 104, 106 project to an extent below the bottom 29 of recess 14 that the design features such as notches 120, 122 in the sides 116 and 118 of said legs can interact with the sliding or locking element 126 on the space between the recess 14 and the bottom unit 124. In this way a display holder 102 can be removed from, or locked into the recess 14 as required. Each sliding or locking element 126 allocated to a recess 14 is formed by two interlinked cutouts 130 and 132 in a plate-shaped element 128, the transitional throat between these cutouts being formed by the projections 134 and 136 which interact with the notches 120, 122 in one of the legs 104 and 106 respectively. Moreover, an end region 138 at one extremity of the cutouts 130, 132—as viewed along their longitudinally axis—forms a step-shaped constriction thereby forming the projections 140, 142. Said projections then interact to the desired extent with the corresponding notches on the other leg 106 or 104 as the case may be. The plate-shaped element 128 can hereby be shifted along the bottom surface 124 of tableau 104 in such a way that the projections 134, 136 and 140, 142 engage in the notches 120, 122 of legs 104 and 106 respectively. In this case the display holder 102 can no longer be removed from recess 14. Conversely, if the plate-shaped element 128 is shifted relative to the cutouts such that the free ends of the legs 104 and 106 lie completely within the cutouts 130 and 132, then said legs will no longer be restricted by the previously mentioned projections, so that display holder 102 can now be taken out of recess 14. In the design example shown in FIG. 13, the plate-shaped element 128, which includes the sliding element 126 serving as the locking device, must be moved towards the lower edge of the drawing in order to allow the display holders to be unlocked.

As is particularly shown on the basis of FIGS. 12 and 13, the cutouts forming the sliding elements 126 are provided in the plate-shaped element 128 corresponding to the arrangement of the recesses 14, so as to make said recesses freely accessible or to lock them to the extent required.

Particularly by reference to drawing FIG. 13, it can also be recognized that the width of the cutouts 130 and 132 let into the plate-shaped element 128 and forming the locking or sliding element 126 is the same as, or greater than the width of legs 104 and 106. Only the transitional throat area between cutouts 130 and 132 and at the extreme edge of the cutout 130 are sufficiently narrow for the thereby formed projections 134, 136, 140, 142 to engage in the notches 120 and 122 of legs 104 and 106 respectively.

So as to permit the plate-shaped element 128 with sliding elements 126 to slide along it to the extent required, the bottom section 124 carries webs 144 and 146, these latter being separated from each other in the region of the locking device 148. A bar (not illustrated) projecting from the locking device 148 can now act on web 144 or 146 as required, so as to allow or to prevent interaction between the element 128, and consequently sliding elements 126, with the display holders 102 mounted in the recesses 14.

In order provide increased stability for the legs 104 and 106, reinforcing ribs 148 can run in their longitudinal direction, as shown in FIG. 14. It can also be seen that externally projecting reinforcing features such as lentiform beads 150 extend from legs 104 and 106 respectively. These reinforcing features engage in recesses 152 in the region of guides 22 and 24, thereby protecting the display holder 102 from unintentionally sliding out, e.g., when the tableau 100 is tipped. Additionally provided in the bottom plate 110 of tableau 100 are slot-shaped receptacles 154, into which the free ends of the legs 104 and 106 can be fitted thereby preventing said legs 104 and 106 from moving together. This arrangement provides additional protection against theft.

Several presentation cases 10 and 100, described in detail on the basis of FIGS. 1 to 7, can now be arranged together to form sales stands, e.g., in the shape of columns 82 (FIG. 8), display walls 84 and 86 (FIG. 9) or panels 90 (FIG. 11) or into rotatable prismatic-section columns 88 (FIG. 10). In particular, the prismatic-section column option, as shown in FIG. 10, hereby offers the advantage that the presentation surface area can be increased by rotating columns 88 to such an extent that the available surface area is apparently tripled.

I claim:

1. A presentation base having a plurality of recesses in the top surface thereof to receive objects, each recess having an internal wall, wherein each said object at least partially surrounds a display holder for mounting in one of said recesses, each display holder having a holding surface to hold said objects for display, said holding surface defined between a pair of edges, at least one projecting section depending from one of said edges, a guideway formed on the internal wall of at least one said recess, said projecting, depending section adapted to fit into a respective guideway, at least one sliding element beneath said top surface of said base, said sliding element adapted to interact with said at least one of said projecting, depending sections, whereby, when said object is arranged on said holding surface and said display holder is inserted in said recess, said object cannot be removed from the display holder.

2. The base of claim 1 wherein each said projecting, depending section is adapted to be engaged in the region of said internal wall by said sliding element.

3. The base of claim 2 wherein each said section has notches in its log sides into which projections from said sliding element fit.

4. The base of claim 1 wherein said display holder has two said sections spaced apart, said sections constituting depending legs.

5. The base of claim 4 wherein there are guideways on opposite internal walls of said recess adapted to engage said each of said sections.

6. The base of claim 1 wherein said sliding element is a plate-shaped element disposed beneath said surface and slidable with respect thereto, said plate-shaped element comprising a cutout portion, each said cutout portion having at least one wide portion and a transition region, said wide portion having at least one complementary portion to said cutout portion, whereby said plate-shaped element is adapted to engage said complementary portion when said sliding element is in a locked position and to be disengaged when said sliding element is in an unlocked position.

7. The base of claim 6 wherein the width of said transition region is greater than the width of said complementary portion.

8. The base of claim 6 wherein said sliding element is provided with a receiving means, a locking element on said base independent of said sliding element and adapted to engage said receiving means and cause said slidable element to slide.

9. The base of claim 1 wherein each said sliding element includes at least one projecting rod for engagement with one said display holder.

10. The base of claim 9 comprising a support beneath said sliding element, at least one web perpendicular to said support and parallel to the direction of movement of said sliding element, an erect portion of said rod parallel to said direction, and a bearing projecting upwardly from said support, said erect portion guided by said bearing.

11. The base of claim 10 wherein said erect portion is offset toward said support.

12. The base of claim 9 wherein said sliding element is provided with a receiving means, a locking element on said base independent of said sliding element and adapted to engage said receiving means and cause said slidable element to slide.

13. The base of claim 9 wherein said projecting section is provided with an opening adapted to be engaged by said rod.

14. The base of claim 1 comprising a support beneath said sliding element, at least one web perpendicular to said support and parallel to the direction of movement of said sliding element, slides in said sliding element complementary to said web and adapted to engage said web.

15. The base of claim 1 wherein said sliding element is provided with a receiving means, a locking element on said base independent of said sliding element and adapted to engage said receiving means and cause said slidable element to slide.

16. The base of claim 1 wherein said object is a wrist watch which substantially surrounds said display holder which is bracelet shaped, said guideways being on opposite internal walls of said recesses, said sliding element having an engaging means mounted thereon and movable between a locking position and an unlocked position, said sliding element engaging said section when in said locking position and not engaging said section when in said unlocked position.

17. The base of claim 16 comprising a rod on said sliding element, an opening in said section, said rod in said opening when said said sliding element is in said locking position and not in said opening when said sliding element is in said unlocked position.

18. The base of claim 17 wherein said slidable element is a plate-shaped element comprising a cutout portion, each said cutout portion having at least one wide portion and a transition region, said wide portion having a complementary portion to said cutput portion.

19. The base of claim 16 wherein a projection is on said section and a complementary indentation is on a corresponding internal wall of said recess, whereby said projection is in said indentation.

20. The base of claim 19 wherein ends of said section remote from said holder enter slots in the bottom of said recess.

21. The base of claim 19 wherein said projection is lentiform.

* * * * *